US009427650B2

(12) United States Patent
Lee

(10) Patent No.: US 9,427,650 B2
(45) Date of Patent: Aug. 30, 2016

(54) APPARATUS AND METHOD FOR VIRTUAL GOLF SIMULATION IMAGING MINI MAP

(75) Inventor: Hyang Rak Lee, Seoul (KR)

(73) Assignee: GOLFZON CO., LTD., Daejeon (KR)

( * ) Notice: Subject to any disclaimer, the term of this patent is extended or adjusted under 35 U.S.C. 154(b) by 311 days.

(21) Appl. No.: 13/520,001

(22) PCT Filed: Dec. 30, 2010

(86) PCT No.: PCT/KR2010/009563

§ 371 (c)(1),
(2), (4) Date: Jun. 29, 2012

(87) PCT Pub. No.: WO2011/081476

PCT Pub. Date: Jul. 7, 2011

(65) Prior Publication Data

US 2012/0277036 A1 Nov. 1, 2012

(30) Foreign Application Priority Data

Dec. 31, 2009 (KR) ..... 10-2009-0136256
Dec. 31, 2009 (KR) ..... 10-2009-0136257

(51) Int. Cl.
*A63B 69/36* (2006.01)
*A63B 71/06* (2006.01)

(52) U.S. Cl.
CPC ..... *A63B 69/3623* (2013.01); *A63B 71/0622* (2013.01); *A63B 2220/80* (2013.01); *A63B 2225/20* (2013.01)

(58) Field of Classification Search
CPC ..... A63B 69/36; A63B 69/3614; A63B 71/0622; A63B 57/00
USPC ..... 463/2, 3; 473/140, 404, 409, 131, 156, 473/407
See application file for complete search history.

(56) References Cited

U.S. PATENT DOCUMENTS 4,086,630 A * 4/1978 Speiser et al. ..... 473/156
5,013,070 A * 5/1991 Maude, Sr. ..... A63B 71/0672 283/48.1

(Continued)

FOREIGN PATENT DOCUMENTS

KR 10-2003-0044601 A 6/2003
KR 10-0790065 B1 1/2008

(Continued)

OTHER PUBLICATIONS

Wii Sports Resort- Golf: Resort A by barolb, YouTube, Aug. 14, 2009, https://www.youtube.com/watch?v=aFm-StGdJYY.*

*Primary Examiner* — James S McClellan
*Assistant Examiner* — Kevin Carter
(74) *Attorney, Agent, or Firm* — Paratus Law Group, PLLC

(57) ABSTRACT

Disclosed herein are an apparatus and method for virtual golf simulation imaging a mini map that provides contents on the mini map for allowing a golfer to recognize the state of a golf course and a state in which a round of golf is being currently played in a virtual golf process through virtual golf simulation in a more active user-oriented form. The apparatus includes a simulation means for performing golf simulation on a virtual golf course, an image processing means for displaying a golf simulation image obtained by the simulation means and a mini map image having a down-scaled image of the virtual golf course displayed in a predetermined region of the golf simulation image, and a mini map control means for controlling a plurality of mini maps showing states and information changed according to progress of the virtual golf simulation performed in the virtual golf course to be displayed step by step.

12 Claims, 11 Drawing Sheets

(56) References Cited

U.S. PATENT DOCUMENTS

| | | | | |
|---|---|---|---|---|
| 5,056,791 | A * | 10/1991 | Poillon et al. | 473/156 |
| 5,319,548 | A * | 6/1994 | Germain | A63B 71/06 273/DIG. 26 |
| 5,398,936 | A * | 3/1995 | Kluttz et al. | 473/156 |
| 5,489,099 | A | 2/1996 | Rankin et al. | |
| 5,917,553 | A * | 6/1999 | Honey et al. | 348/578 |
| 6,141,060 | A * | 10/2000 | Honey et al. | 348/578 |
| 7,154,540 | B2 * | 12/2006 | Honey et al. | 348/222.1 |
| 2004/0147329 | A1 * | 7/2004 | Meadows | A63B 57/00 473/131 |
| 2008/0018667 | A1 * | 1/2008 | Cheng et al. | 345/632 |
| 2008/0084325 | A1 | 4/2008 | Kim et al. | |
| 2008/0293488 | A1 * | 11/2008 | Cheng et al. | 463/31 |
| 2009/0036237 | A1 * | 2/2009 | Nipper et al. | 473/409 |
| 2011/0028196 | A1 * | 2/2011 | Choi | 463/3 |
| 2011/0299729 | A1 * | 12/2011 | Dawe et al. | 382/103 |
| 2012/0238380 | A9 * | 9/2012 | Marty et al. | 473/407 |
| 2013/0030903 | A1 * | 1/2013 | Spivack | 705/14.35 |

FOREIGN PATENT DOCUMENTS

| | | | |
|---|---|---|---|
| KR | 10-0815398 | B1 | 3/2008 |
| KR | 10-2008-0030004 | A | 4/2008 |
| WO | WO 93-22011 | A1 | 11/1993 |

* cited by examiner

APPARATUS AND METHOD FOR VIRTUAL GOLF SIMULATION IMAGING MINI MAP

CROSS REFERENCE TO PRIOR APPLICATIONS

This application is a National Stage Patent Application of PCT International Patent Application No. PCT/KR2010/009563 (filed on Dec. 30, 2010) under 35 U.S.C. §371, which claims priority to Korean Patent Application Nos. 10-2009-0136256 (filed on Dec. 31, 2009) and 10-2009-0136257 (filed on Dec. 31, 2009), which are all hereby incorporated by reference in their entirety.

TECHNICAL FIELD

The present invention relates to a virtual golf simulation apparatus, and, more particularly, to a virtual golf simulation apparatus wherein a virtual golf course is imaged and simulated, and the trajectory of a golf ball hit by a user, i.e. a golfer, is simulated in the virtual golf course.

BACKGROUND ART

With the recent upsurge of the golfing population, a so-called screen golf system has gained popularity, which allows a golfer to practice golf and to enjoy a virtual golf game using a virtual golf simulation apparatus.

The screen golf system senses the velocity and direction of a golf ball that a golfer hits onto a screen installed indoors for displaying a virtual golf range, and displays the trajectory of the golf ball on the screen.

The screen golf system implemented using the virtual golf simulation apparatus characteristically offers the same sense of reality that a golfer would feel in a real golf course, when the golfer hits a golf ball in the same manner as in a golf practice range.

It is necessary for the virtual golf simulation apparatus to provide various contents based on various kinds of advanced apparatuses and systems, which cannot be provided by a real golf course or a golf practice range, thereby inducing interest of golfers in addition to provision of the same sense of reality that a golfer would feel playing a round of golf in a real golf course.

DISCLOSURE OF INVENTION

Technical Problem

Therefore, it is an object of the present invention to provide an apparatus and method for virtual golf simulation imaging a mini map that is capable of providing contents on the mini map for allowing a golfer to recognize the state of a golf course and a state in which a round of golf is being currently played at a glance in a virtual golf process through virtual golf simulation in a more active user-oriented form, thereby improving golfer convenience and inducing interest in virtual golf.

Solution to Problem

In accordance with one aspect of the present invention, the above and other objects can be accomplished by the provision of an apparatus for virtual golf simulation in a golf course including a simulation means for performing golf simulation on a virtual golf course, an image processing means for displaying a golf simulation image simulated by the simulation means and a mini map image having a downscaled image of the virtual golf course displayed in a predetermined region of the golf simulation image, and a mini map control means for controlling a plurality of mini maps showing states and information changed according to progress of the virtual golf simulation performed in the virtual golf course to be displayed step by step.

In accordance with another aspect of the present invention, there is provided an apparatus for virtual golf simulation in a golf course including a simulation means for performing golf simulation on a virtual golf course, an image processing means for displaying a golf simulation image obtained by the simulation means and a mini map image in which the virtual golf course is displayed in a predetermined region of the golf simulation image in a scaled-down state, and an animation means for displaying the trajectory of a golf ball calculated by the simulation means on the mini map during the progress of the golf simulation and displaying an animation in which the size of the golf ball displayed on the mini map is changed according to the trajectory height of the golf ball on the mini map.

In accordance with another aspect of the present invention, there is provided an apparatus for virtual golf simulation in a golf course including a simulation means for performing golf simulation on a virtual golf course, an image processing means for displaying a golf simulation image obtained by the simulation means and a mini map image having a downscaled image of the virtual golf course displayed in a predetermined region of the golf simulation image, and a weather animation means for displaying weather conditions according to weather information on at least one selected from a group consisting of wind direction, wind velocity, rainfall, and snowfall in the corresponding golf course on the mini map in the form of an animation.

In accordance with another aspect of the present invention, there is provided a method for virtual golf simulation in a golf course including sensing a hit golf ball, simulating a trajectory of the golf ball in the virtual golf course based on the sensing result, determining progress conditions of the virtual golf simulation according to the simulation result, and displaying a mini map based on a corresponding step among a plurality of mini maps showing states and information changed in a step by step fashion according to the determined progress conditions of the virtual golf simulation.

In accordance with another aspect of the present invention, there is provided a method for virtual golf simulation in a golf course including displaying a virtual golf course image and a mini map of the golf course, sensing a hit golf ball, simulating a trajectory of the golf ball in the virtual golf course based on the sensing result, and displaying an animation in which the size of the golf ball is changed according to the trajectory height of the golf ball based on the simulation on the mini map.

In accordance with a further aspect of the present invention, there is provided a method for virtual golf simulation in a golf course including performing golf simulation with respect to a virtual golf course, displaying a mini map having a downscaled image of the virtual golf course displayed in a predetermined region of the golf simulation image, displaying a wind object indicating wind direction and wind velocity on the mini map according to weather information in the corresponding golf course, and controlling the wind object to be moved in a direction corresponding to the wind direction according to the weather information at a velocity corresponding to the wind velocity according to the weather information.

Advantageous Effects of Invention

In the virtual golf simulation apparatus and method according to the present invention as described above, it is possible to provide contents on the mini map for allowing a golfer to recognize the state of a golf course and a state in which a round of golf is being currently played at a glance in a virtual golf process through virtual golf simulation in a more active user-oriented form. Consequently, the present invention has the effect of improving golfer convenience and inducing interest in virtual golf.

BRIEF DESCRIPTION OF DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, exemplary embodiments of a virtual golf simulation apparatus according to the present invention will be described in detail with reference to the accompanying drawings.

The virtual golf simulation apparatus according to the present invention may be embodied in various forms. Typically, the virtual golf simulation apparatus according to the present invention may be applied to a so-called screen golf system.

Figure 1:
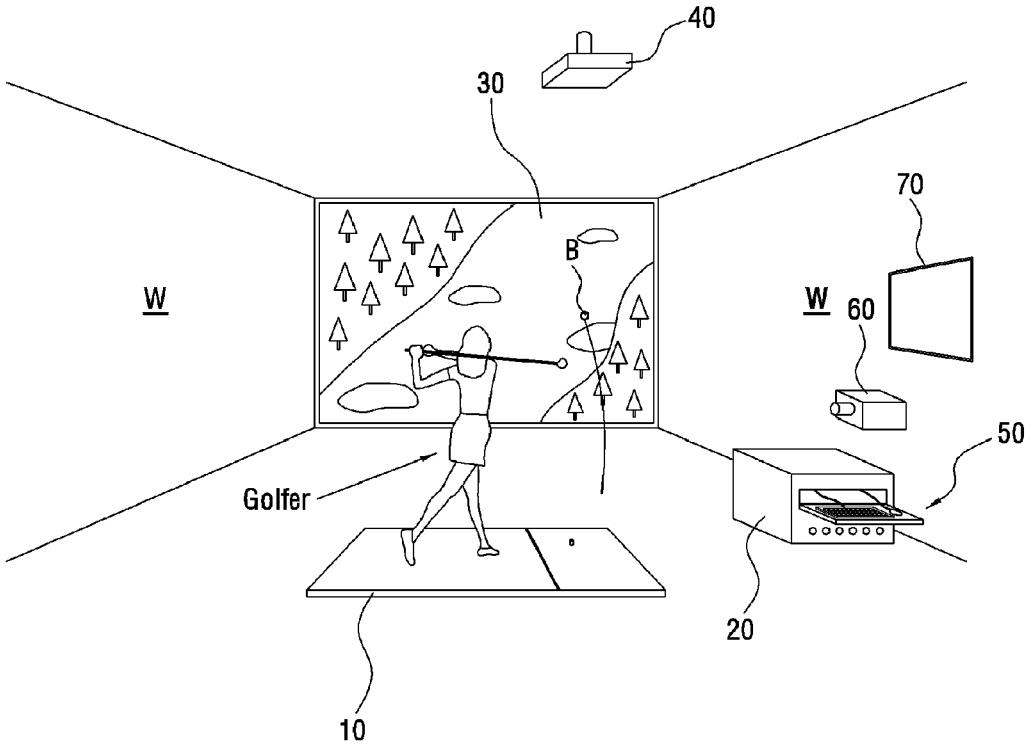
FIG. 1 is a view illustrating a screen golf system to which a virtual golf simulation apparatus according to an embodiment of the present invention is applied.
Figure 2:
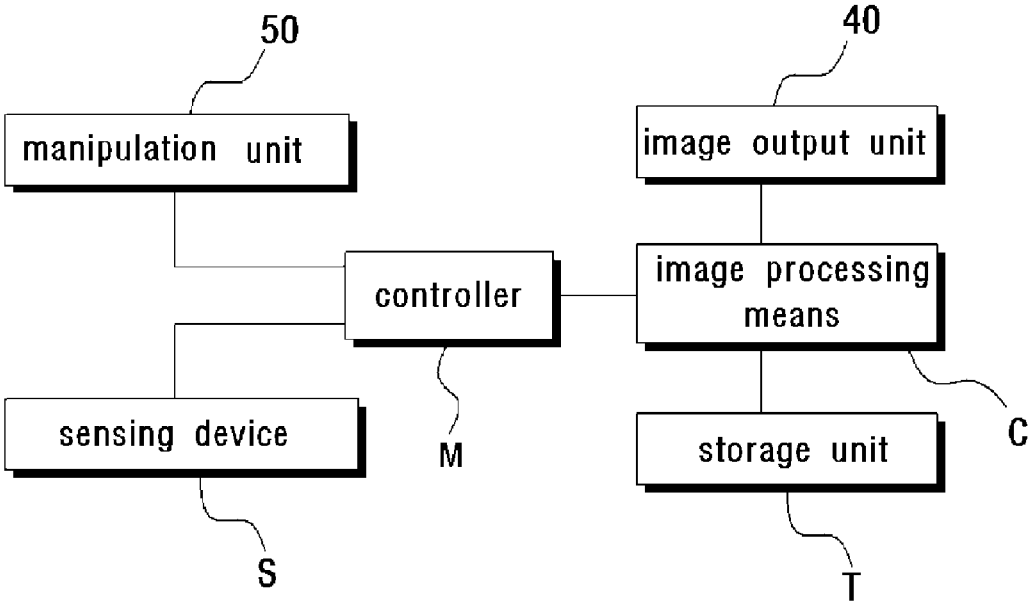
FIG. 2 is a block diagram illustrating a control system of a virtual golf simulation apparatus according to an embodiment of the present invention.

FIGS. 1 and 2 illustrate an example in which a virtual golf simulation apparatus according to the present invention is applied to a screen golf system, to which, however, the present invention is not limited. For example, the present invention may be applied to all kinds of systems and/or apparatuses that are capable of simulating and imaging a virtual golf course and simulating a virtual golf ball image.

Hereinafter, an example in which a virtual golf simulation apparatus and method according to the present invention are applied to a screen golf system will be described with reference to FIGS. 1 to 2.

As shown in FIGS. 1 and 2, a virtual golf simulation apparatus according to an embodiment of the present invention includes a sensing device S for sensing a golf swing performed by a golfer and/or the movement of a golf ball B hit by the golfer, an image output unit 40 for outputting a predetermined image to a screen 30 disposed in front of the image output unit 40, and a simulation means, i.e. a simulator 20, for storing and processing all data necessary for virtual golf simulation.

Also, the virtual golf simulation apparatus according to this embodiment of the present invention further includes a manipulation unit for allowing a golfer to manipulate a system setting or various kinds of settings necessary to perform a virtual golf game.

FIG. 1 illustrates a keyboard and mouse set 50 as an example of the manipulation unit. A touch screen 70 mounted at a side wall W of a booth may be provided as an example of the manipulation unit.

Meanwhile, although not shown, a remote control (not shown) may be provided as the manipulation unit so that the remote control can directly communicate with the simulator or the touch screen to manipulate virtual golf simulation.

It may be inconvenient for a golfer standing on a swing plate 10 to manipulate the keyboard and mouse set 50 or the touch screen 70 shown in FIG. 1. For this reason, it may be possible to provide a key manipulation unit (not shown) disposed at the swing plate 10 for allowing a golfer who is ready to swing on the swing plate 10 to conveniently manipulate settings for virtual golf simulation as an example of the manipulation unit.

Also, a camera 60 may be mounted to the side wall W of the booth to capture swings of a golfer, as shown in FIG. 1.

Meanwhile, the simulator 20 may include an image processing means C, a storage unit T and a controller M.

The storage unit T stores all data necessary for virtual golf simulation including data on a virtual golf course. The image processing means C is provided to process all images related to virtual golf simulation, such as images related to a virtual golf course, images related to movement of a golf ball, and images for menu selection, as data stored in the storage unit T.

The controller M is provided to perform various calculations for virtual golf simulation and to control components of the virtual golf simulation apparatus.

That is, when a golfer hits a golf ball on the swing plate 10 to the screen 30, the sensing device S senses the shot of the golf ball, and transmits the sensing result to the controller M. The controller M transmits the sensing result to the image processing means C. The image processing means C extracts golf simulation image information, such as a movement image of the golf ball, from the storage unit T in consideration of movement properties of the golf ball. The golf simulation image information is projected on the screen 30 through the image output unit 40 so that a golf game through virtual simulation is performed.

Although not clearly shown in FIG. 1, the sensing device S (see FIG. 2) may be embodied by an infrared light transmitting and receiving sensor mounted at the swing plate 10 or a camera sensor mounted at the ceiling or the wall. In addition, the sensing device S may be embodied by other different sensors.

Figure 3:
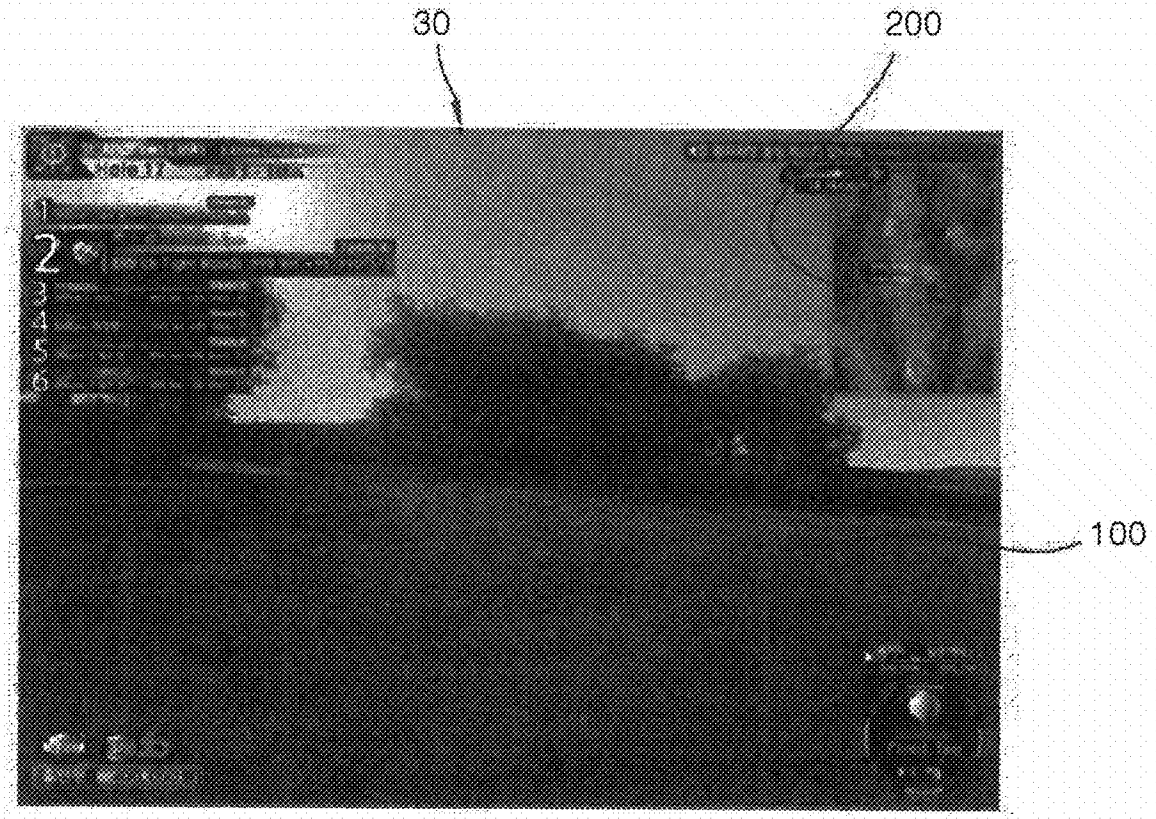
FIG. 3 is a view illustrating an example of an image output to a screen in the screen golf system shown in FIG. 1.

FIG. 3 is a view illustrating an example in which an image output from the virtual golf simulation apparatus according to this embodiment of the present invention as described above is displayed on the screen 30.

As shown in FIG. 3, the virtual golf simulation apparatus according to this embodiment of the present invention is configured to provide a simulation image 100 of a virtual golf course embodied by the simulation means and an image of a mini map 200 having a downscaled image of the virtual golf course displayed in a predetermined region of the golf simulation image through the image processing means C.

On the mini map 200 are displayed a downscaled image of all or some of a hole at which a virtual golf game is being currently played and information on the state of the hole so that the downscaled image and the state information can be recognized at a glance.

Also, the virtual golf simulation apparatus according to this embodiment of the present invention further includes a mini map control means for displaying a plurality of mini maps showing states and information changed according to progress of the virtual golf simulation performed in the virtual golf course step by step.

Figure 4:
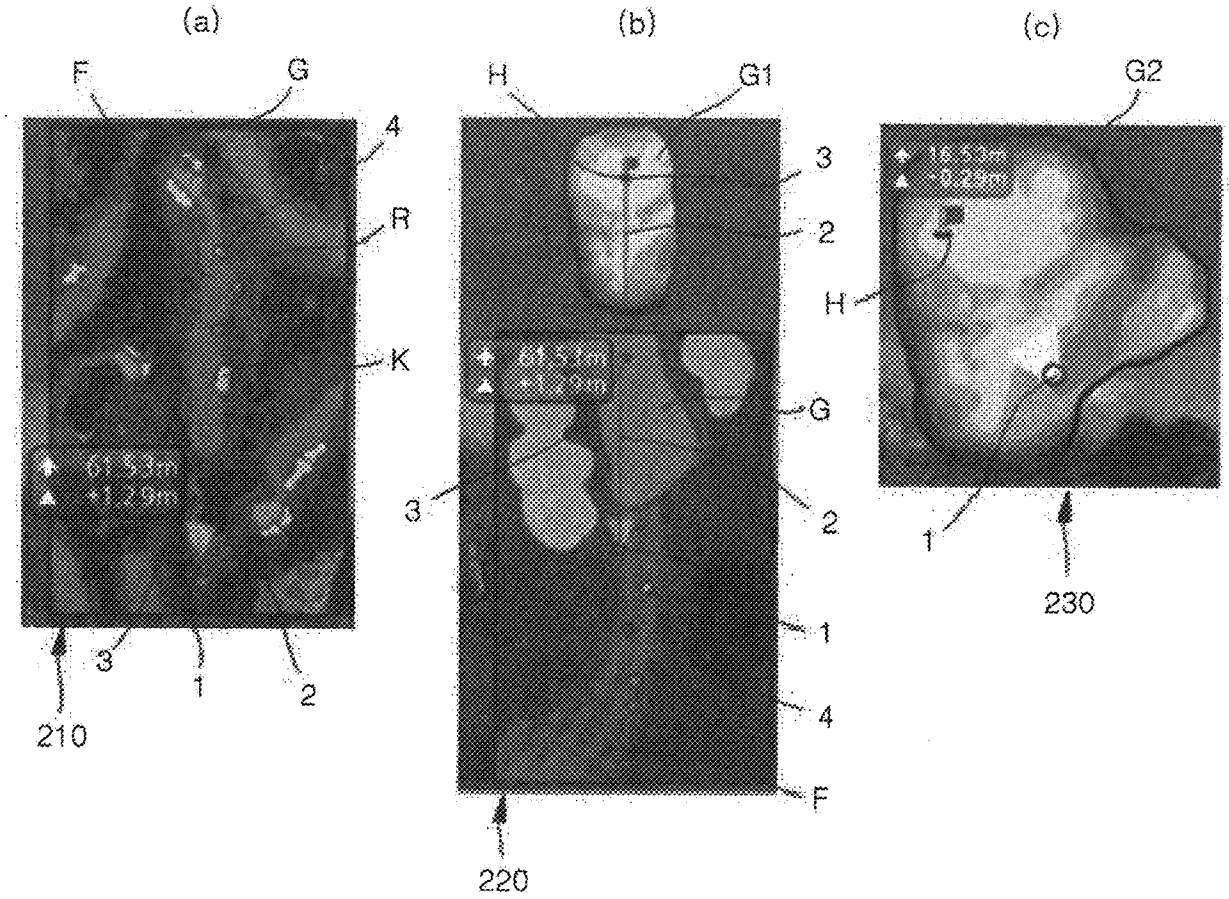
FIGS. 4(*a*), 4(*b*) and 4(*c*) are views illustrating mini maps provided by a virtual golf simulation apparatus according to an embodiment of the present invention.

That is, FIG. 4(*a*) illustrates a hole mini map 210, FIG. 4(*b*) illustrates a double mini map 220, and FIG. 4(*c*) illustrates a green mini map 230. The mini map control means of the virtual golf simulation apparatus according to this embodiment of the present invention provides the above mini maps in a step by step fashion according to the progress of the virtual golf simulation.

The hole mini map 210 shows the entire area of a corresponding hole. The double mini map 220 separately shows a specific area adjacent to a green G of the corresponding hole and a green area G1. The green mini map 230 shows the state of a green G2 and various kinds of information on the green G2.

A fairway F, a rough R, a bunker K, and a green G are selectively displayed on the hole mini map 210 and the double mini map 220. Preferably, golf balls 1 and 4, etc. hit by golfers are displayed using different colors.

Preferably, the golf ball 1 hit by the golfer who is currently playing is displayed together with a guide line 2 and a target point 3. Preferably, the guide line 2 and the target point 3 are changed through manipulation performed by the golfer using the manipulation unit.

In a case in which the target point 3 is not located at the hole cup H (in a case in which the golf ball is distant, more than a predetermined distance, from the hole cup with the result that it is difficult for the golfer to locate the target point 3 at the hole cup H by manipulating the guide line 2), the hole mini map 210 is preferably displayed. On the other hand, in a case in which the target point 3 is located at the hole cup H (in a case in which the golf ball is not located on the green G, and the golf ball is close, less than the predetermined distance, to the hole cup with the result that it is easy for the golfer to locate the target point 3 at the hole cup H by manipulating the guide line 2), the double mini map 220 is preferably displayed.

When the golf ball 1 has duly reached the green G, the green mini map 230 is preferably displayed.

The mini map display sequence may be changed according to the state of a hole at which a round of golf is being currently played. For a par 5 hole, for example, the hole mini map 210, the double mini map 220, and the green mini map 230 may be sequentially displayed. For a par 3 hole, on the other hand, the hole mini map 210 is displayed, and, when a first shot has duly reached the green G, the green mini map 230 is immediately displayed without displaying the double mini map 220.

Preferably, the green G1 on the double mini map 220 briefly shows information on the state of the green. That is, topographical information of the green may be displayed using contour lines, color change, or brightness change.

Preferably, the green G2 on the green mini map 230 concretely shows information on the state of the green.

That is, it is possible to display high and low guide information (not shown) necessary to show and guide the lie of a green through color change or brightness change and information on comparison between the topographical height of a place at which the golf ball is located and the topographical height of the hole cup in the form of texts or simple symbols.

In this way, the mini maps are actively changed according to simulation progress conditions, and therefore, it is possible to provide active contents for golfers through the mini maps.

Hereinafter, a mini map provided by a virtual golf simulation apparatus according to another embodiment of the present invention will be described in detail with reference to FIG. 5.

Figure 5:
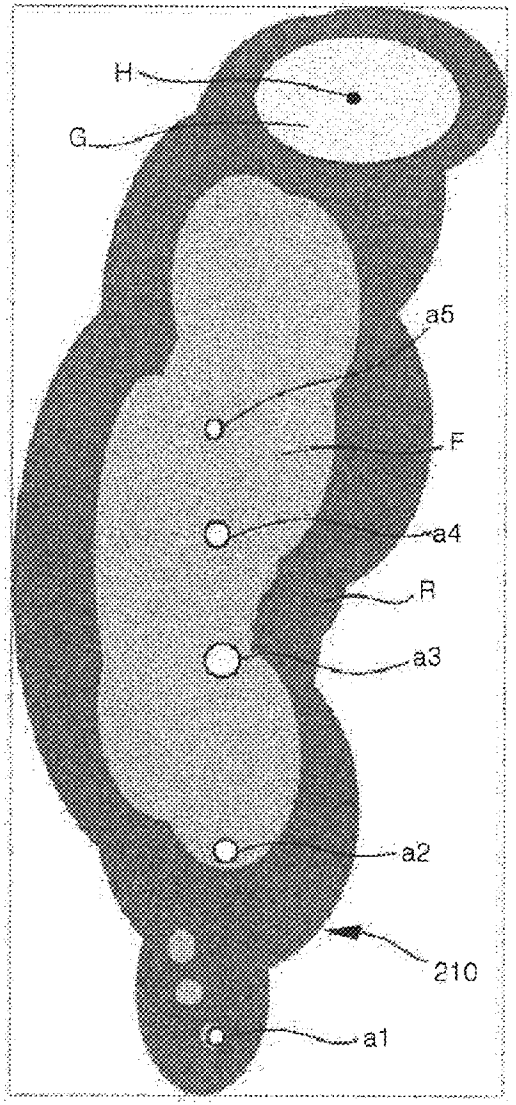
FIG. 5 is a view illustrating a mini map provided by a virtual golf simulation apparatus according to another embodiment of the present invention.

FIG. 5 is a view illustrating a moving route of a golf ball displayed in the form of an animation on a hole mini map.

That is, the virtual golf simulation apparatus according to this embodiment of the present invention is characterized in that the virtual golf simulation apparatus includes an animation means for displaying the movement of a golf ball on a mini map in the form of a predetermined animation when the golf ball hit by a golfer is sensed and simulated by a sensing device during the progress of virtual golf simulation.

The moving animation of the golf ball on the mini map may be displayed in various forms. In an example shown in FIG. 5, an animation in which the size of the golf ball is changed according to the flight height of the golf ball based on the trajectory of the golf ball, which is being simulated, is displayed.

That is, as shown in FIG. 5, the golf ball is moved in states of a1→a2→a3→a4→a5. In the respective states, the size of the golf ball is different from each other. That is, the size of the golf ball is gradually increased until the golf ball flies to the highest (in the state of a3), and the size of the golf ball is gradually decreased from the state of a3 until the golf ball falls on the fairway F, which is displayed in the form of an animation.

Also, although not shown in the drawing, the animation means of the virtual golf simulation apparatus according to this embodiment of the present invention may be configured to display an animation in which the golf ball moving on the mini map is rotated based on a spin value of the golf ball measured by the sensing device.

In particular, as shown in FIG. 5, it is possible to simultaneously provide an animation in which the size of the golf ball is changed according to the flight height of the golf ball based on the trajectory of the golf ball and an animation in which the golf ball is rotated based on the measured spin value of the golf ball on the mini map.

In this way, the animation on movement of the golf ball is vividly and excitingly displayed on the mini map, and therefore, it is possible to provide active contents for golfers through the mini map.

In FIG. 5, reference symbols F, R, G and H indicate a fairway, a rough, a green and a hole cup, respectively.

Hereinafter, mini maps provided by a virtual golf simulation apparatus according to another embodiment of the present invention will be described in detail with reference to FIG. 6.

Figure 6:
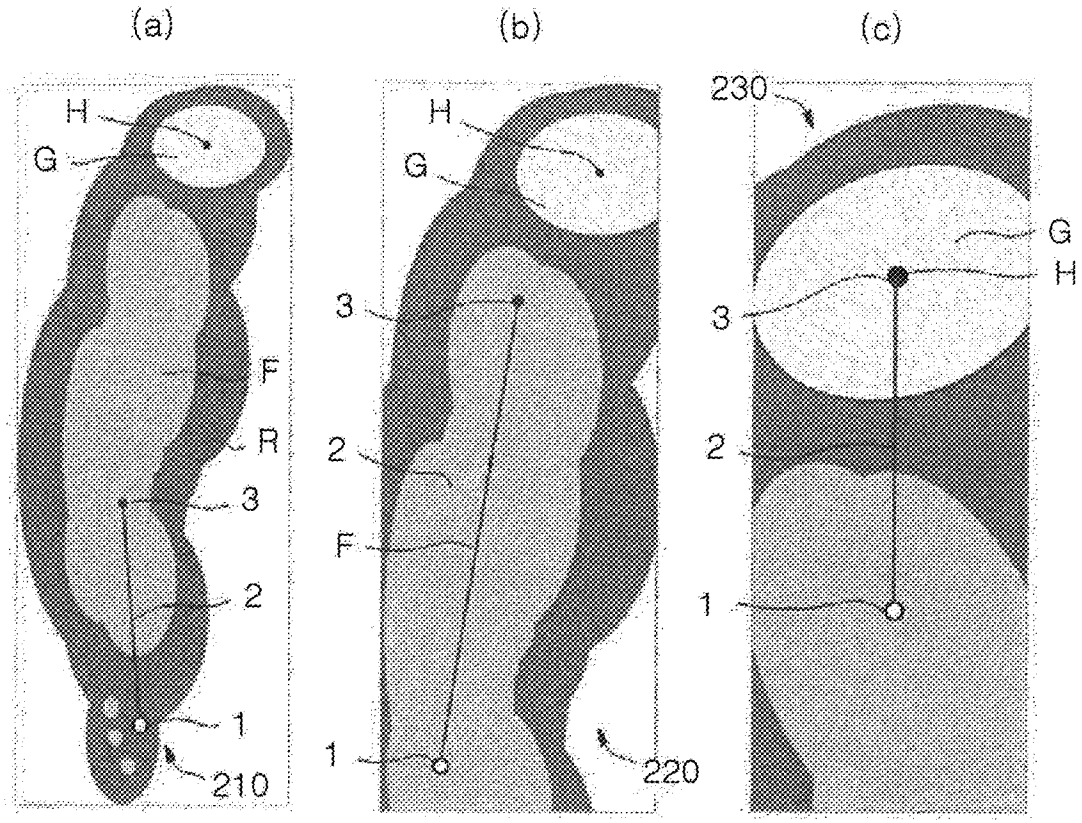
FIGS. 6(*a*), 6(*b*) and 6(*c*) are views illustrating mini maps provided by a virtual golf simulation apparatus according to another embodiment of the present invention.

FIG. 6(*a*) illustrates a hole mini map 210. A mini map 211 illustrated in FIG. 6(*b*) is a map which is scaled up according to a ratio of the currently remaining distance to the initial distance on the hole mini map. A mini map 212 illustrated in FIG. 6(*c*) is a map which is scaled up according to a ratio of the remaining distance on the mini map 211 illustrated in FIG. 6(*b*). Here, the remaining distances is the distance between the golf ball and the hole cup.

That is, the virtual golf simulation apparatus according to this embodiment of the present invention is characterized in that the virtual golf simulation apparatus includes a mini map control means for controlling a hole at which a round of golf is being currently played on the mini maps according to a ratio of the currently remaining distance to the initial distance on the hole at which the round of golf is being currently played in the virtual golf course based on the progress conditions of the golf simulation to be displayed in a scaled-up state or in a scaled-down state.

As shown in FIG. 6, the entire sizes of the mini maps are the same, and the image of the hole is scaled up according to a ratio of the currently remaining distance to the initial distance. If the remaining distance is decreased, the mini maps are scaled up. On the other hand, if the remaining distance is increased, the mini maps are scaled down.

Preferably, both the golf ball 1 and the hole cup H are included when the mini maps are scaled up or down.

In this way, the mini maps are displayed in a scaled-up state or in a scaled-down state according to simulation progress conditions in addition to the virtual golf simulation image, and therefore, it is possible to provide active contents for golfers through the mini maps.

Figure 7:
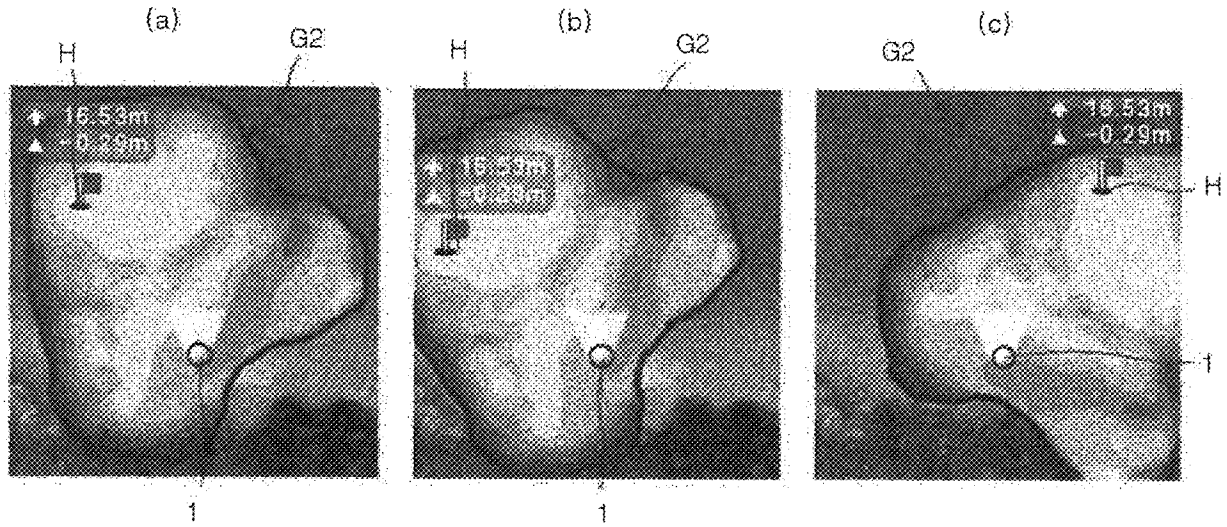
FIGS. 7(*a*), 7(*b*) and 7(*c*) are views illustrating mini maps provided by a virtual golf simulation apparatus according to another embodiment of the present invention.

FIG. 7 illustrates modes in which the green mini map is rotated through manipulation performed by a golfer using the manipulation unit.

That is, the green G2 on the green mini map is rotated according to manipulation performed by the golfer using the manipulation unit. At this time, the green G2 on the green mini map may be rotated about the golf ball 1 or about the hole cup H.

In this way, a golfer may rotate the green to confirm the state of the green when the golfer putts a golf ball, and therefore, it is possible to provide active golfer-oriented contents.

Figure 8:
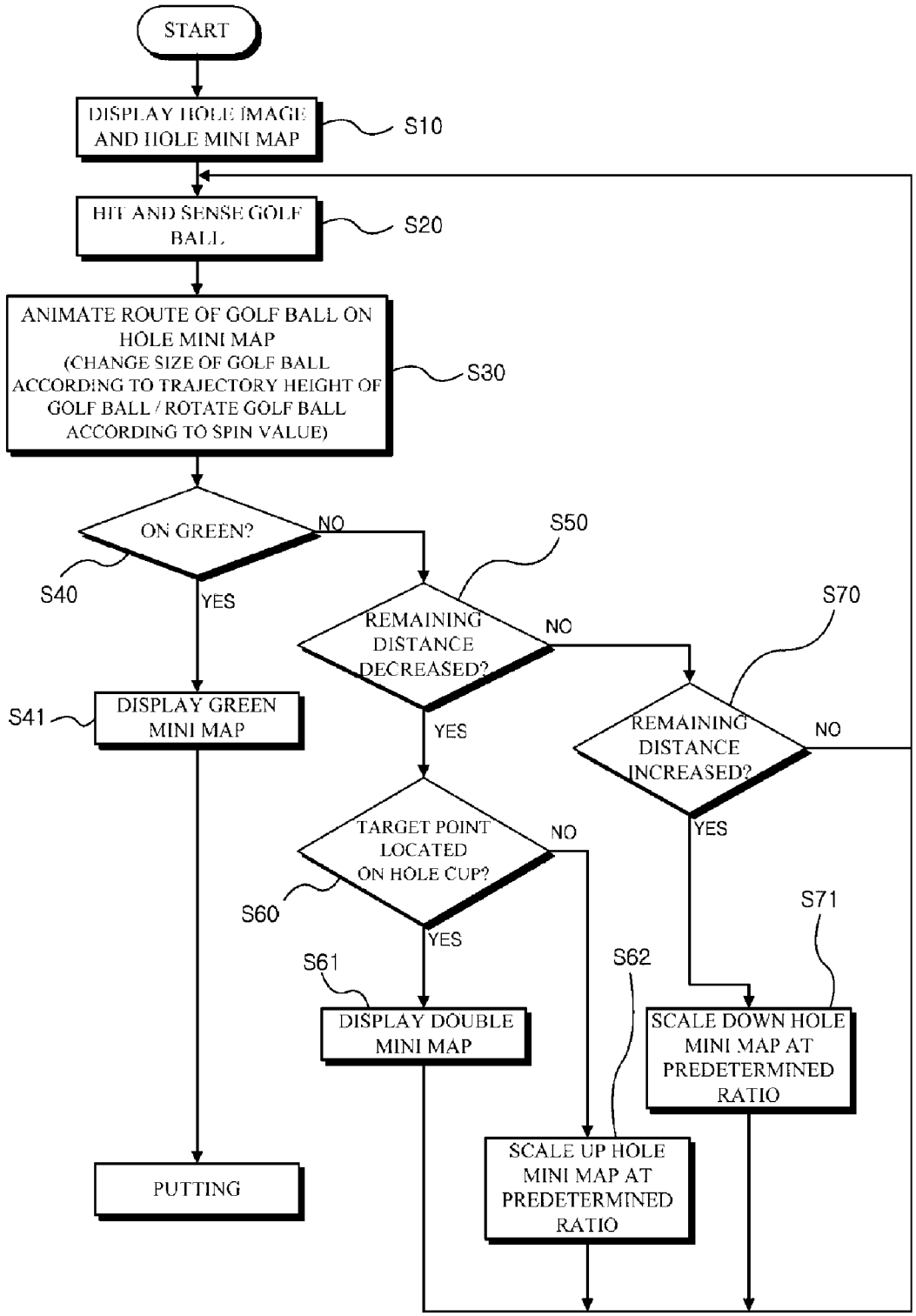
FIG. 8 is a flow chart related to mini maps provided by the virtual golf simulation apparatus according to the present invention.

Hereinafter, a flow chart related to mini maps provided by the virtual golf simulation apparatus according to the present invention will be described. The flow chart of FIG. 8 is applied to the respective embodiments of the virtual golf simulation apparatus according to the present invention.

First, an image of a hole at which a round of golf is played and a hole mini map are displayed upon start of virtual golf simulation (S10).

When a golfer hits a golf ball on a swing plate, the hit golf ball is sensed by the sensing device (S20).

The trajectory of the golf ball is simulated and imaged according to the sensing result. At this time, the route of the golf ball is displayed in the form of an animation on a hole mini map (S30).

Subsequently, it is determined whether the virtual golf ball has duly reached a green (S40). Upon determining that the virtual golf ball has duly reached the green, a green mini map is displayed (S41).

Upon determining that the virtual golf ball has not duly reached the green yet, on the other hand, it is determined whether the remaining distance from the golf ball to the hole cup has been decreased as compared with a previous position (S50).

Upon determining that the remaining distance has been decreased, it is determined whether a target point is located on the hole cup (S60). Upon determining that the target point is located on the hole cup, a double mini map is displayed (S61). Upon determining that the target point is not located on the hole cup, on the other hand, the hole mini map is maintained. In this case, however, the hole mini map is displayed in a state in which the hole mini map is scaled up at a predetermined ratio (S62).

Upon determining that the remaining distance has not been decreased, on the other hand, it is determined whether the remaining distance has been increased (S70). Upon determining that the remaining distance has been increased, the hole mini map is displayed in a state in which the hole mini map is scaled down at a predetermined ratio (S71).

Hereinafter, a virtual golf simulation apparatus according to a further embodiment of the present invention will be described in detail with reference to FIGS. 9 to 12.

The virtual golf simulation apparatus according to this embodiment of the present invention shown in FIGS. 9 to 12 is characterized in that the virtual golf simulation apparatus includes a weather animation means for displaying weather conditions according to weather information on wind direction, wind velocity, rainfall, snowfall, etc. in a corresponding golf course on a mini map in the form of an animation.

Figure 9:
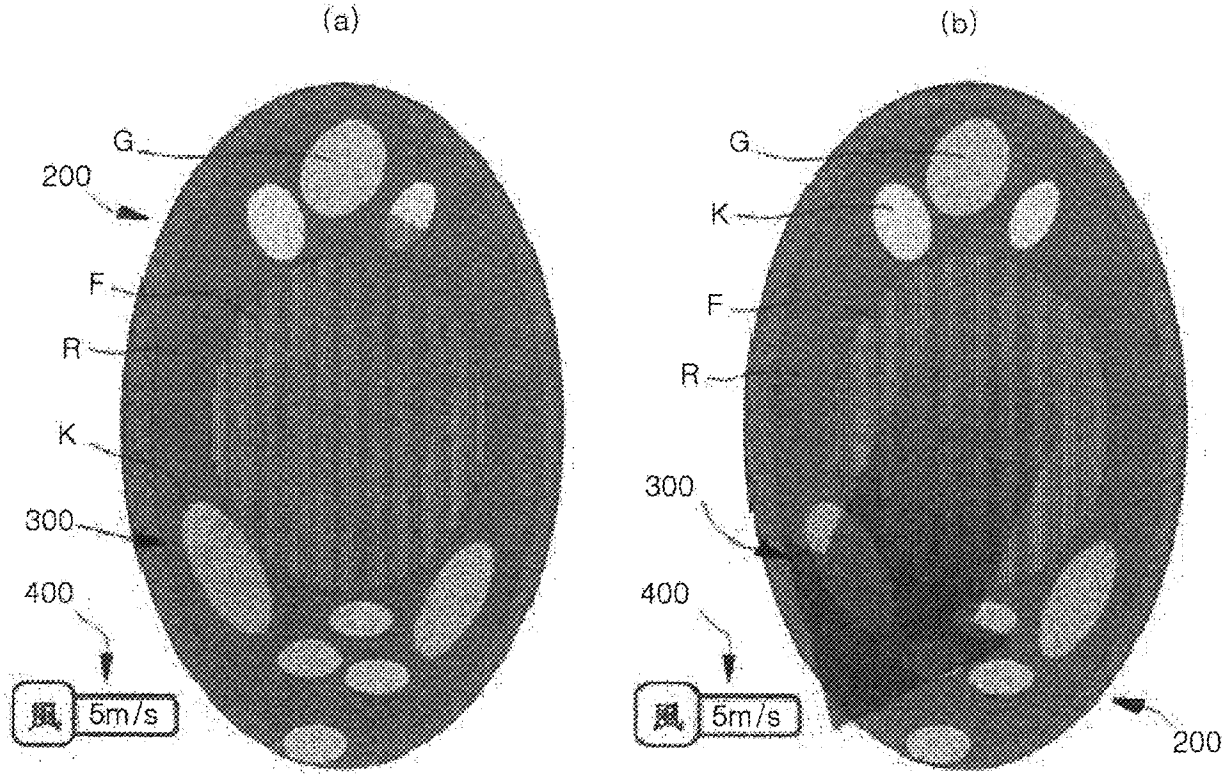
FIGS. 9 to 11 are views illustrating weather animation examples which are displayed on a mini map provided by a virtual golf simulation apparatus according to a further embodiment of the present invention.
Figure 10:
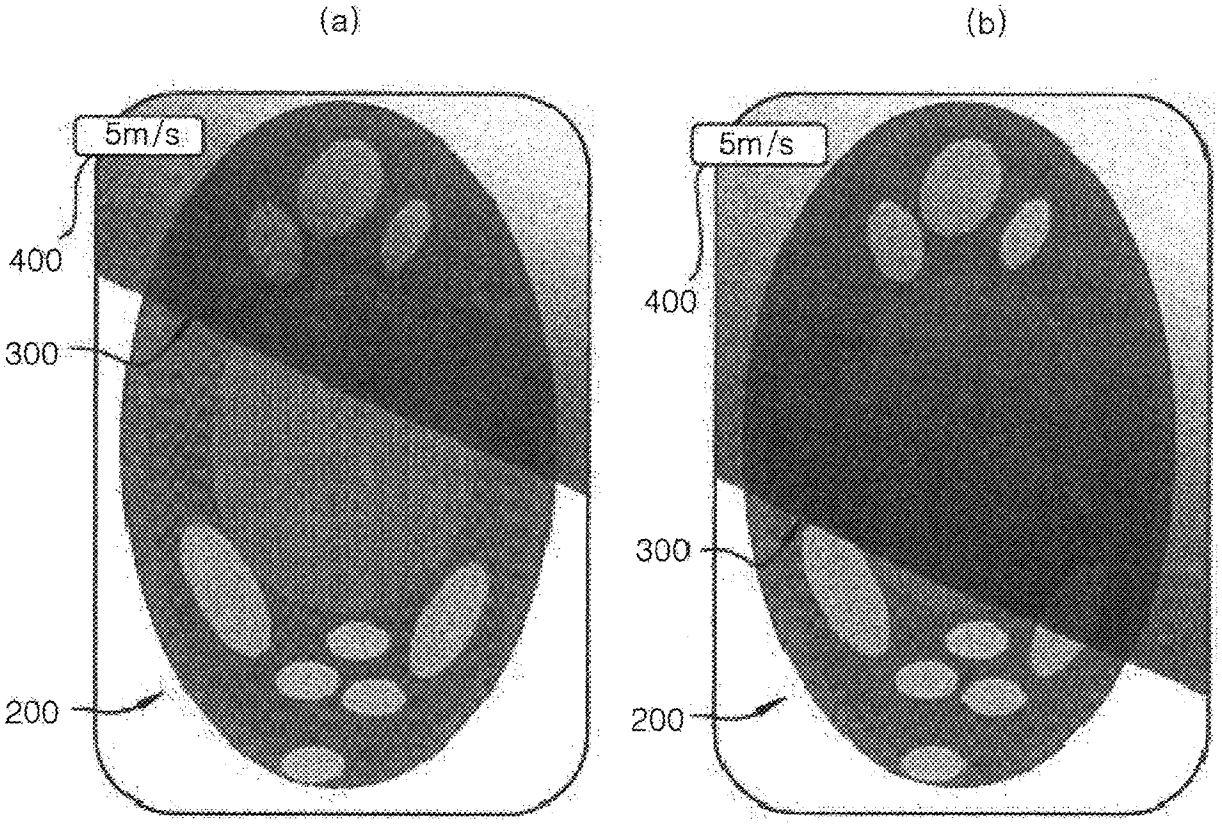

FIGS. 9 and 10 illustrates examples in which weather conditions according to weather information on wind direction and wind velocity in a corresponding golf course is displayed on the mini map in the form of an animation.

As shown in FIGS. 9 and 10, the mini map is a map displayed in a state in which a corresponding hole is scaled down. A fairway F, a rough R, a bunker K, a green G, and a hole cup H are selectively displayed on the mini map.

The weather animation means displays weather information on wind direction and wind velocity in the golf course on the mini map in the form of a weather animation. As shown in FIGS. 9 and 10, a wind object 300 may be displayed on the mini map 200 to display wind direction and wind velocity in the form of an animation using the wind object 300.

The wind object 300 may be displayed in various forms. FIGS. 9(*a*) and 9(*b*) illustrate the wind object 300 which is displayed in the shape of an arrow.

As shown in FIGS. 9(*a*) and 9(*b*), the arrow-shaped wind object 300 is displayed to cover a portion of the mini map. In this case, however, the wind object 300 exhibits a predetermined degree of transparency so that the state of the mini map 200 is revealed.

As shown in FIGS. 9(*a*) and 9(*b*), therefore, a direction indicated by the wind object 300 is wind direction.

Also, the wind object 300 is displayed in the form of an animation which is changed from a state shown in FIG. 9(*a*) to a state shown in FIG. 9(*b*), i.e. the color of which is changed in a gradation mode. Preferably, wind velocity is indicated according to change speed of the gradation.

That is, the wind object 300 shown in FIG. 9 is displayed in the form of an animation which is repeatedly changed from the state shown in FIG. 9(*a*) to the state shown in FIG. 9(*b*). Fast change of the gradation indicates that the wind velocity is high. On the other hand, slow change of the gradation indicates that the wind velocity is low.

Also, a text display means 400 is preferably displayed on the mini map 200 for providing text information on wind direction and/or wind velocity in addition to the wind object 300.

Meanwhile, the wind object 300 shown in FIGS. 10(*a*) and 10(*b*) is displayed to cover the mini map 200 at a predetermined degree of transparency while the wind object has no specific shape. The wind object is animated so that the wind object is moved in a direction based on wind direction to indicate wind direction and wind velocity.

That is, the wind object 300 is moved from a state shown in FIG. 10(*a*) to a state shown in FIG. 10(*b*). The direction in which the wind object 300 is moved corresponds to wind direction, and the velocity at which the wind object 300 is moved corresponds to wind velocity. Movement of the wind object 300 in the southwestern direction indicates a southwestern wind. Also, fast movement of the wind object indicates that the wind velocity is high. On the other hand, slow movement of the gradation indicates that the wind velocity is low.

Reference numeral 400 indicates a text display means for providing text information on wind direction and/or wind velocity.

As described above, a weather animation on wind direction and wind velocity is displayed on the mini map, and therefore, it is possible to provide more active contents through the mini map. Also, it is possible for a golfer to intuitively obtain feeling on wind direction and wind velocity and, in addition, to feel a particular interest.

Figure 11:
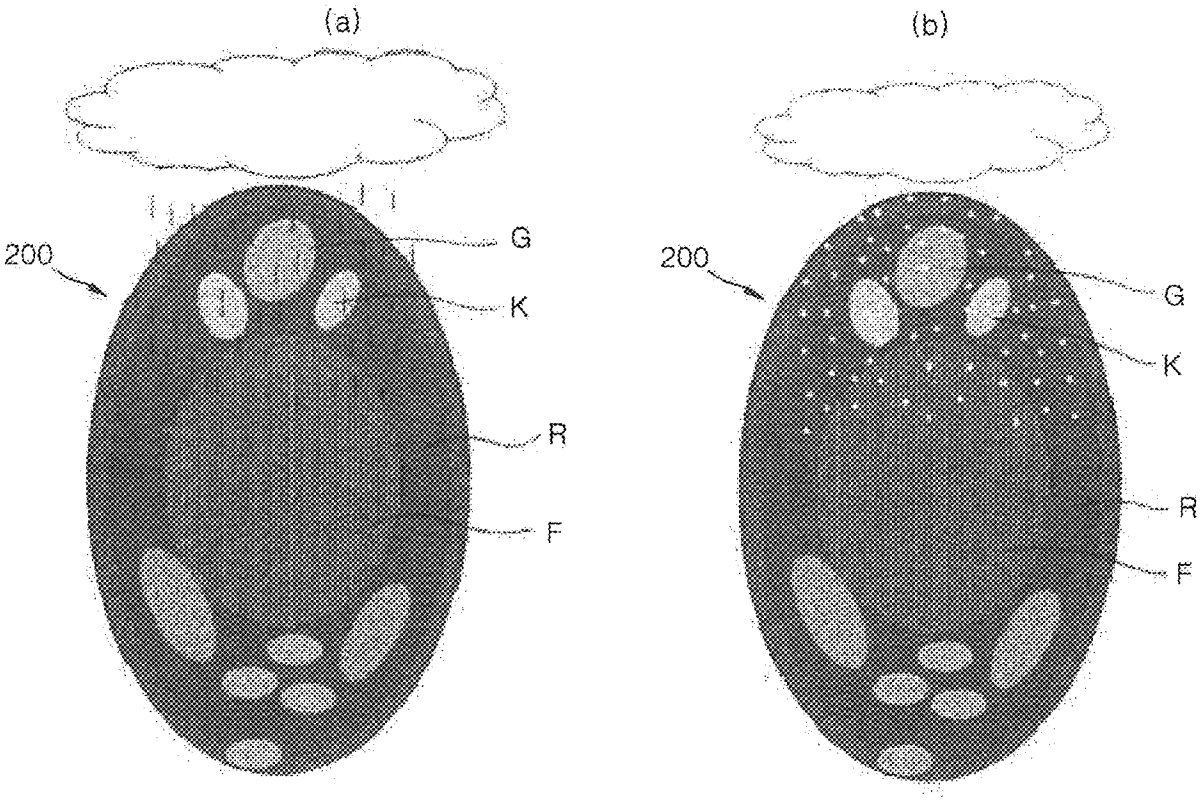

Meanwhile, as shown in FIGS. 11(*a*) and 11(*b*), weather information on rainfall or snowfall may be displayed on the mini map 200 in the form of weather information.

That is, as in an example shown in FIG. 11(*a*), a cloud image is displayed on the upper end of the mini map 200, and it is animated that rain falls from a cloud with the result that it is possible for a golfer to recognize that rain is falling in a current golf course through the mini map.

Also, as in an example shown in FIG. 11(*b*), a cloud image is displayed on the upper end of the mini map 200, and it is animated that snow falls from a cloud with the result that it is possible for a golfer to recognize that snow is falling in a current golf course through the mini map.

Hereinafter, a weather information provision flow on the mini map provided by the virtual golf simulation apparatus according to the present invention will be described in detail with reference to a flow chart shown in FIG. 12.

Figure 12:
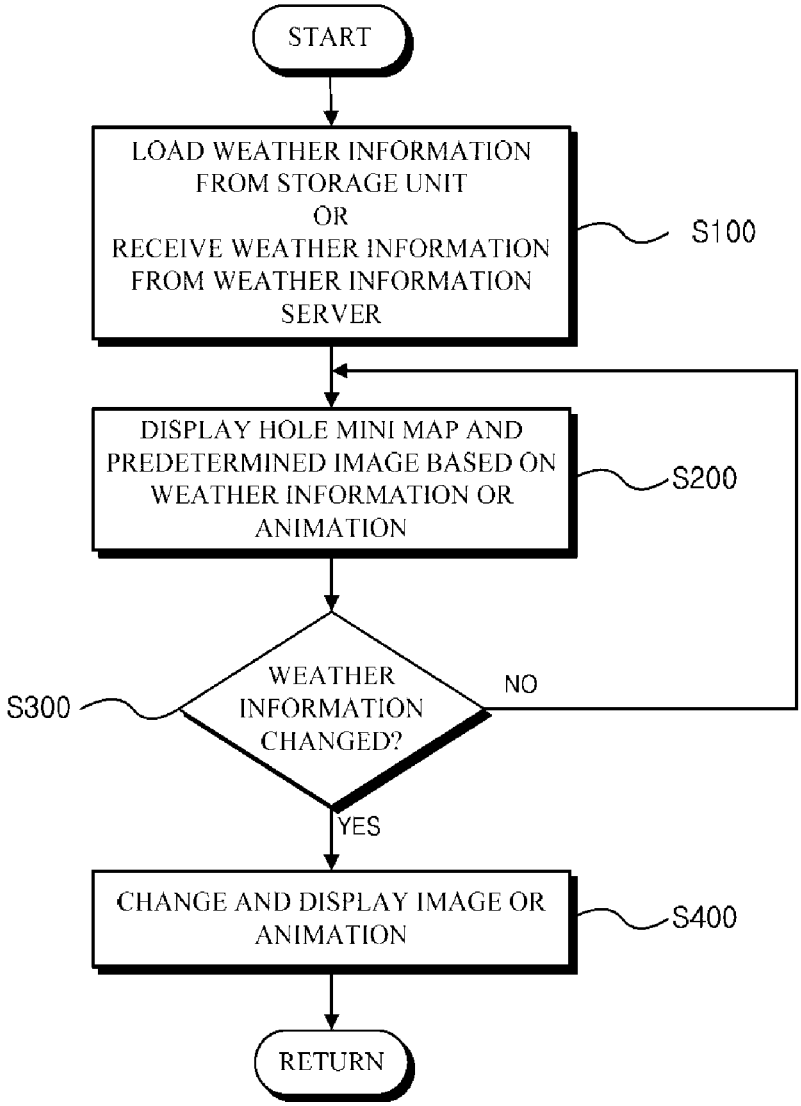
FIG. 12 is a flow chart related to a weather animation provided by the virtual golf simulation apparatus according to the present invention.

As shown in FIG. 12, displaying a weather animation on weather information through the mini map starts with loading or reception of the weather information (S100).

A virtual golf course may simulate a real golf course. The simulator of the virtual golf simulation apparatus receives weather information on the real golf course from a weather information server, and a weather animation is displayed on the mini map based on the received weather information (S200).

Also, the weather information may be set as arbitrary information, and the weather animation may be displayed on the mini map based on the arbitrary information. That is, data on weather information may be stored in the storage unit of the simulator, and the weather information is loaded to the controller according to predetermined program so that the controller displays a weather animation on the mini map through the image processing means (S200).

Meanwhile, either arbitrary weather information stored in the storage unit of the simulator or weather information received from the weather information server in real time may be changed or updated with the passage of time. The controller determines whether the weather information has been changed (S300). Upon determining that the weather information has been changed, the weather animation is changed and displayed according to the changed weather information (S400).

MODE FOR THE INVENTION

Various embodiments of an apparatus and method for the virtual golf simulation imaging mini map have been described in the best mode for carrying out the invention.

INDUSTRIAL APPLICABILITY

In the apparatus and method for the virtual golf simulation imaging the mini map according to the present invention as described above, it is possible to provide contents on the mini map for allowing a golfer to recognize the state of a golf course and a state in which a round of golf is being currently played at a glance in a virtual golf process through virtual golf simulation in a more active user-oriented form, thereby improving golfer convenience and inducing interest on virtual golf. Consequently, the present invention can be widely used in industries related to the apparatus and method for the virtual golf simulation imaging the mini map.

The invention claimed is:

1. A method for virtual golf simulation for a user to play golf on a virtual golf course, the method comprising:

sensing a flight of a golf ball hit by the user;

simulating a trajectory of the hit golf ball on a hole of the virtual golf course currently played, based on a sensing result;

displaying on a screen or a display device a simulation image which shows the simulated trajectory of the hit golf ball on the hole currently played;

displaying in a predetermined region of the simulation image a mini map which shows a downscaled image of a whole or a part of the hole currently played together with a state and information on the hole;

displaying on the displayed mini map a wind object which indicates a wind direction and a wind velocity according to weather information on the virtual golf course currently played, wherein the wind object is overlapped with the downscaled image of the whole or the part of the hole on the displayed mini map at a predetermined degree of transparency such that a part of the mini map illustrated under the overlapped wind object is visible; and moving the wind object overlapped with the downscaled image on the displayed mini map from a first position to a second position on the downscaled image on the displayed mini map in a direction corresponding to the wind direction at a velocity corresponding to the wind velocity according to the weather information such that the part of the downscaled image on the mini map illustrated under the overlapped moving wind object is visible and a size of an area that the downscaled image is overlapped with the wind object varies.

2. The virtual golf simulation method according to claim 1, wherein the wind direction and the wind velocity displayed in the form of the animation on the displayed mini map are obtained from predetermined weather information which is stored or obtained from weather information received from a weather information server.

3. The virtual golf simulation method according to claim 1, wherein the step of displaying the wind object comprises displaying the weather information on the downscaled image of the hole on the displayed mini map in the form of predetermined text.

4. The virtual golf simulation method according to claim 1, wherein the step of displaying the wind object comprises animating the wind object in which at least one of a shape, a form, and a color of the wind object is changed on the displayed mini map.

5. The virtual golf simulation method according to claim 1, wherein a moving velocity of the animated wind object is changed in correspondence to the wind velocity of the wind object according to the weather information.

6. A virtual golf simulation apparatus for a user to play golf on a virtual golf course realized by imaging processing, comprising:

a sensing device which senses a golf ball hit by the user;

a controller which simulates a trajectory of the hit golf ball on a hole of the virtual golf course currently played, based on a sensing result; and an image processing means configured to:

display on a screen or a display device a simulation image which shows a simulated trajectory of the hit golf ball on the hole currently played, display a predetermined region of the simulation image a mini map which shows a downscaled image of a whole or a part of the hole currently played together with a state and information on the hole, display on the displayed mini map a wind object which indicates a wind direction and a wind velocity according to weather information on the virtual golf course currently played, wherein the wind object is overlapped with the downscaled image of the whole or the part of the hole on the displayed mini map at a predetermined degree of transparency such that a part of the mini map illustrated under the overlapped wind object is visible, and move the wind object overlapped with the downscaled image on the displayed mini map from a first position to a second position on the downscaled image on the displayed mini map in a direction corresponding to the wind direction at a velocity corresponding to the wind velocity according to the weather information such that the part of the downscaled image of the whole or the part of the hole on the mini map illustrated under the overlapped moving wind object is visible and a size of an area that the downscaled image is overlapped with the wind object varies.

7. The virtual golf simulation apparatus of claim 6, wherein the controller is configured to determine progress of a virtual golf simulation currently played according to a simulation result, and determine a mini map among plurality types of mini maps each configured to show different state and information on the hole currently played, according to the determined progress of the virtual golf simulation, wherein the plurality types of mini maps include:

a hole mini map showing the entirety of a corresponding hole, a double mini map showing both i) a portion of the corresponding hole including a green and a specific area adjacent to the green, and ii) a whole green area of the corresponding hole illustrated with information on a state of the green and separately illustrated from the portion of the corresponding hole, and a green mini map showing the entirety of the green showing information on the state of the green more concretely than the whole green area, wherein the image processing means is configured to sequentially display the hole mini map, the double mini map, and the green mini map in a predetermined region of the simulation image in a step by step fashion according to the determined progress of the virtual golf simulation.

8. The virtual golf simulation apparatus of claim 7, wherein the controller determines the progress of the virtual golf simulation by determining a distance between the golf ball and a hole cup during the progress of the virtual golf simulation.

9. The virtual golf simulation apparatus of claim 7, wherein the image processing means is configured to display the determined mini map in a scaled-up state or in a scaled-down state according to a ratio of the currently remaining distance to the initial distance on the hole currently played based on the progress of the golf simulation to be displayed.

10. The virtual golf simulation apparatus of claim 7, wherein the image processing means is configured to display an animation in which the size of the golf ball is changed according to a trajectory height of the golf ball based on the virtual golf simulation on the displayed mini map.

11. The virtual golf simulation apparatus of claim 10, wherein the image processing means is configured to display an animation in which the golf ball is rotated according to a spin property of the golf ball based on the simulation on the displayed mini map.

12. The virtual golf simulation apparatus of claim 11, wherein the controller is configured to calculate the size of the golf ball so that size of the golf ball corresponds to the flight height of the golf ball according to the trajectory of the golf ball, and the image processing means is configured to change the golf ball moving along the trajectory in correspondence to the calculated size on the displayed mini map.

* * * * *